US010460641B2

(12) United States Patent
Shin et al.

(10) Patent No.: US 10,460,641 B2
(45) Date of Patent: Oct. 29, 2019

(54) IMAGE PROCESSING CIRCUIT AND DISPLAY DEVICE USING THE HISTOGRAM ANALYZER TO PERFORM A DIFFERENTIAL SHIFT AND EXTENSION SHIFT OF IMAGE DATA GRAY LEVEL TO ADJUST GRAY LEVEL RESPECT TO THE BRIGHTNESS IMAGE LEVEL

(71) Applicant: LG Display Co., Ltd., Seoul (KR)

(72) Inventors: Hong-Seop Shin, Goyang-si (KR); Kyong-Ho Lim, Paju-si (KR); Yu-Hoon Kim, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 248 days.

(21) Appl. No.: 15/154,440

(22) Filed: May 13, 2016

(65) Prior Publication Data

US 2016/0351102 A1 Dec. 1, 2016

(30) Foreign Application Priority Data

May 28, 2015 (KR) ..... 10-2015-0074915
Apr. 14, 2016 (KR) ..... 10-2016-0045430

(51) Int. Cl.
*G09G 3/20* (2006.01)
*G09G 3/36* (2006.01)
*G09G 3/34* (2006.01)

(52) U.S. Cl.
CPC ..... *G09G 3/2007* (2013.01); *G09G 3/2011* (2013.01); *G09G 3/3607* (2013.01); *G09G 3/3648* (2013.01); *G09G 3/342* (2013.01); *G09G 2320/0238* (2013.01); *G09G 2320/0252* (2013.01); *G09G 2320/064* (2013.01); *G09G 2320/0646* (2013.01);
(Continued)

(58) Field of Classification Search
CPC .... G09G 3/342; G09G 3/3611; G09G 3/3426; G09G 3/3406; G09G 3/3233; G09G 3/3685; G09G 3/003
See application file for complete search history.

(56) References Cited

U.S. PATENT DOCUMENTS 7,382,349 B1 * 6/2008 Kuhns ..... G09G 3/3685 345/102
2005/0212736 A1 * 9/2005 Lu ..... G09G 3/3611 345/87

(Continued)

FOREIGN PATENT DOCUMENTS

CN 1717714 A 1/2006
CN 1892793 A 1/2007

(Continued)

*Primary Examiner* — Jennifer Mehmood
*Assistant Examiner* — James S Nokham
(74) *Attorney, Agent, or Firm* — Dentons US LLP

(57) ABSTRACT

Disclosed are an image processing circuit and image processing method which is capable of enhancing gray level presentation, and a display device using the same. The image processing circuit and image processing method performs a differential extension of each gray level to a higher gray level with respect to a perceived brightness picture level (PBPL) reflecting a distribution of high gray levels of the input image, and then overdrives a light emitting device in the region of high gray levels higher than or equal to the threshold gray level.

10 Claims, 14 Drawing Sheets

(52) U.S. Cl.
CPC ..... *G09G 2320/0673* (2013.01); *G09G 2320/103* (2013.01); *G09G 2360/145* (2013.01)

(56) References Cited

U.S. PATENT DOCUMENTS

2005/0248592 A1* 11/2005 Feng ..... G09G 3/3426 345/690
2006/0071936 A1* 4/2006 Leyvi ..... G09G 3/342 345/589
2007/0001997 A1* 1/2007 Kim ..... G09G 3/3406 345/102
2008/0001974 A1* 1/2008 Kim ..... G09G 3/3233 345/690
2008/0007512 A1* 1/2008 Honbo ..... G09G 3/3406 345/102
2008/0291153 A1* 11/2008 Zhang ..... G09G 3/3611 345/102
2008/0317372 A1* 12/2008 Kwon ..... G06T 5/008 382/263
2010/0066752 A1* 3/2010 Watanuki ..... G09G 3/3426 345/589
2010/0079504 A1* 4/2010 Chen ..... G09G 3/3406 345/690
2011/0141077 A1* 6/2011 Cho ..... G09G 3/3426 345/207
2015/0371594 A1* 12/2015 Huang ..... G09G 3/003 345/690

FOREIGN PATENT DOCUMENTS

CN 101097684 A 1/2008
CN 101149903 A 3/2008
CN 101312017 A 11/2008
CN 101325035 A 12/2008
CN 101676983 A 3/2010
KR 10-2007-0002920 A 1/2007
WO 2004/049293 A1 6/2004

* cited by examiner

IMAGE PROCESSING CIRCUIT AND DISPLAY DEVICE USING THE HISTOGRAM ANALYZER TO PERFORM A DIFFERENTIAL SHIFT AND EXTENSION SHIFT OF IMAGE DATA GRAY LEVEL TO ADJUST GRAY LEVEL RESPECT TO THE BRIGHTNESS IMAGE LEVEL

This application claims the benefit of Korean Patent Applications No. 10-2015-0074915, filed on May 28, 2015 and No. 10-2016-0045430, filed on Apr. 14, 2016, which are hereby incorporated by reference as if fully set forth herein.

BACKGROUND

Field of the Invention

The present disclosure relates to an image processing circuit and image processing method which are capable of enhancing gray level presentation, and a display device using the same.

Discussion of the Related Art

A dynamic range of images referred to a range of presentable luminance from a dark portion to a bright portion in an input image. High dynamic range (HDR) displays, which have recently come into the spotlight, are capable of displaying an image with very high contrast, deep black and very bright white.

In conventional cases, to implement such HDR display, an average picture level (APL), which is an average of all gray levels of an input image, or a brightness enhancement weight of an image obtained through discrete cosine transform is used to switch a server to widen the dynamic range of the input image.

However, with the average gray level or transformation into the frequency domain alone, perceived brightness characteristics according to gray level distribution may not be reflected, and thus a range narrower than the high dynamic range of human sight may be obtained.

In addition, if the histogram is stretched by applying the APL to the all gray levels for an image having high distribution of high gray levels or/and low gray levels, the middle gray levels are not stretched and thus an inflection point may occur between the middle gray levels and the low gray levels and between the middle gray levels and the high gray levels. These inflection points may result in artifacts in the images.

SUMMARY

Accordingly, the present invention is directed to an image processing circuit, image processing method, and display device using the same that substantially obviate one or more problems due to limitations and disadvantages of the related art.

An advantage of the present invention is to provide an image processing circuit and image processing method which are capable of enhancing gray level presentation, and a display device using the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an image processing circuit and image processing method may, for example, perform a differential shift from each gray level to a lower gray level with respect to a perceived darkness picture level (PDPL) reflecting a distribution of low gray levels of an input image, and then perform a differential extension of each gray level to a higher gray level with respect to a perceived brightness picture level (PBPL) reflecting a distribution of high gray levels of the input image.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
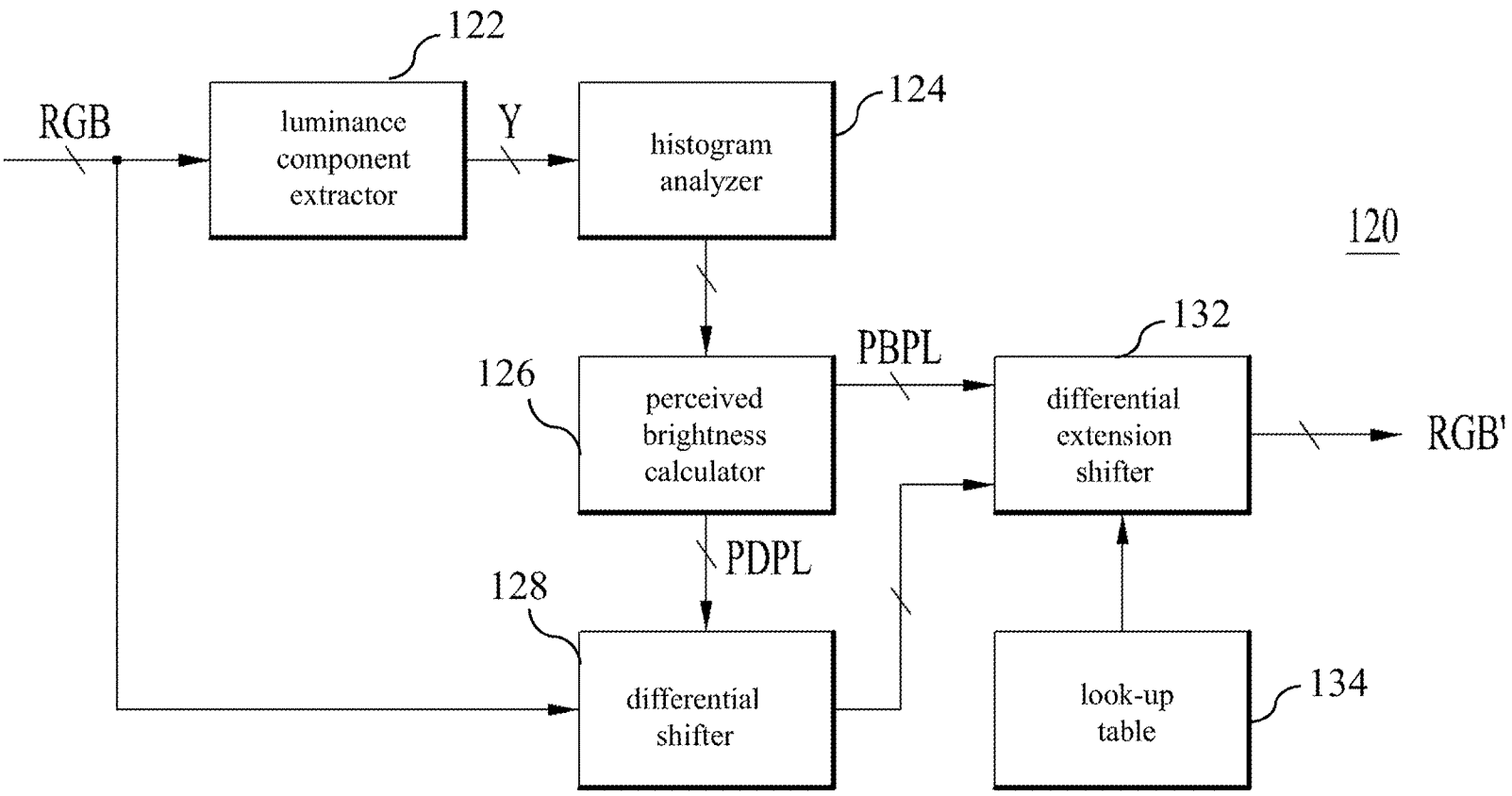
FIG. 1 is a block diagram illustrating an image processing circuit according to an embodiment of the present invention.

FIG. 1 is a block diagram illustrating an image processing circuit according to an embodiment of the present invention.

Referring to FIG. 1, an image processing circuit 120 includes a luminance component extractor 122, a histogram analyzer 124, a perceived brightness calculator 126, a differential shifter 128, a differential extension unit 132 and a look-up table 134.

The luminance component extractor 122 separates image data RGB of a currently input frame into a luminance component Y and a chrominance component based on a color format conversion algorithm or conversion function. For example, the luminance component extractor 122 extracts a luminance component Y based on a conversion function as shown in Equation 1.

$$Y=0.2229\times R(\text{gray value})+0.587\times G(\text{gray value})+0.114\times B(\text{gray value}) \quad \text{Equation 1}$$

The histogram analyzer 124 generates a histogram of each frame by analyzing the luminance component Y extracted by the luminance component extractor 122. For example, when a display panel includes M×N pixels, the histogram analyzer 124 classifies M×N luminance components Y into respective gray levels, counts the frequency of luminance components Y corresponding to each gray level, and then generates a histogram consisting of frequencies (or proportions) for the respective gray levels.

Then, the histogram analyzer 124 calculates the maximum luminance component Ymax and minimum luminance component Ymin from the generated histogram. That is, the histogram analyzer 124 calculates the minimum luminance component Ymin corresponding to the lowest gray level for which the frequency is n % (wherein n is a positive integer less than 10) and the maximum luminance component Ymax corresponding to the highest gray level for which the frequency is n % (wherein n is a positive integer less than 10).

The perceived brightness calculator 126 calculates a perceived darkness picture level (PDPL), which indicates the degree of distribution of low grays of an input image based on the brightness perception properties of human beings, and a perceived brightness picture level (PBPL), which indicates the degree of distribution of high grays of an input image based on the brightness perception properties of human beings. Herein, low gray and high gray depend on the properties (e.g., size, drive power, service life, etc.) of the display device and the purpose of use thereof.

As shown in Equation 2 below, the PDPL is calculated using each input gray level Grayij of the input image and the maximum luminance component Ymax generated by the histogram analyzer 124.

$$PDPL=\frac{\sum_{i=1}^{M}\sum_{j}^{N}\text{Gray}_{ij}\times(Y_{max}-\text{Gray}_{ij})}{\sum_{i=1}^{M}\sum_{j}^{N}(Y_{max}-\text{Gray}_{ij})}E \quad \text{Equation 2}$$

In Equation 2, when the input gray value Grayij decreases (to a lower gray level), the weight Ymax-Grayij increases. However, since the value of the denominator of Equation 2 also increases, the PDPL is lowered. When the input gray value Grayij increases (to a higher gray level), the weight Ymax-Grayij decreases. However, since the value of the denominator of Equation 2 also decreases, the PDPL is raised.

Accordingly, lowering the PDPL indicating the degree of perceived brightness may mean higher proportion of low gray values in the input image of one frame, while raising the PDPL may mean lower proportion of low gray values in the input image of one frame.

The PBPL is calculated based on each input gray value Grayij as shown in Equation 3 below.

$$PBPL=\frac{\sum_{i=1}^{M}\sum_{j}^{N}\text{Gray}_{ij}\times\text{Gray}_{ij}}{\sum_{i=1}^{M}\sum_{j}^{N}\text{Gray}_{ij}}E \quad \text{Equation 3}$$

In Equation 3, the PBPL is proportional to the square of the input gray value. Accordingly, lowering the PBPL may mean lower proportion of high gray values in the input image of one frame, while raising the PBPL may mean high proportion of high gray values in the input image of one frame.

Further, in Equation 3, the value of the numerator of PBPL is proportional to the square of the input gray value, and thus the PBPL corresponding to each input gray is raised compared to the input gray. Accordingly, as the difference in the PBPL between neighboring gray values increases, the brightness components of neighboring input gray values are highlighted.

The differential shifter 128 shifts each input gray $\text{Gray}_{in}$ to the negative direction by the shift constant C(shift) calculated in Equation.

That is, if the input gray value Grayin is greater than the minimum luminance component Ymin and less than the maximum luminance component Ymax, the input image is subjected to differential shift of each input gray value to a lower gray value as the shift constant C(shift) calculated in Equation 4 is subtracted from each input gray value.

$$C(\text{shift})-\alpha\times PDPL\times\left(1-\frac{\text{Grayin}-Y\text{min}}{(Y\text{max}-Y\text{min})}\right) \quad \text{Equation 4}$$

In Equation 4, a denotes an experimental constant and has a value greater than 0 and less than 2.

If the input gray Grayin is less than the minimum luminance component Ymin, a value equal to the minimum luminance component Ymin is input to the input gray Grayin, and thus the shift constant C(shift) has the maximum value α×PDPL. Therefore, if the input gray Grayin is less than the minimum luminance component Ymin, the input gray value is shifted to the minimum value (0 gray value).

If the input gray Grayin is greater than the maximum luminance component Ymax, a value equal to the maximum luminance component Ymax is input to the input gray Grayin, and thus the shift constant C(shift) has 0 as a value. Therefore, if the input gray Grayin is greater than the maximum luminance component Ymax, the input gray values may be maintained rather than being shifted to lower gray levels, and thus the maximum gray may be prevented from being lowered.

As shown in Equation 4, the shift constant C(shift) is proportional in proportion to PDPL. Accordingly, as the value of PDPL for images decreases, the value of C(shift) for shift to a lower gray level decreases, and thus the degree of saturation of low gray may be reduced. On the other hand, for an image having a high PDPL, a shift is appropriately performed in consideration of the brightness characteristics of the image, and thus the distribution property of the histogram of the image may be maintained.

The differential extension unit 132 extends the gray values of an input image shifted to lower gray levels toward higher gray levels, based on the differential gain PXLgain. That is, as shown in Equation 5, the differential gain PXLgain for each input gray level is calculated by multiplying the function of PBPL f(PBPL), input gain (gain LUT) for each gray level reflecting the perception property and the gain constant β. Herein, β is a gain constant to adjust the scale of the differential gain PXLgain, f(PBPL) is a function having PBPL as a variable. LUTgain is a normalized gain value mapped to each input gray level. LUTgain is stored in the look-up table 134.

$$PXL_{gain_m}=(\beta\times f(\text{PDPL})\times\text{normalized gain } LUT_m \qquad \text{Equation 5}$$

For a dark image having a PBPL lower than the threshold, a high value of PXLgain is computed through Equation 5 to enhance overall brightness and gray presentation of the image. For a bright image having a PBPL higher than the threshold, a low value of PXLgain which does not cause saturation of high gray levels is computed. In particular, for input images having a PBPL higher than the threshold, the determined value of PXLgain, which is a differential gain for each input gray level, decreases as the gray value increases. For input images having a PBPL lower than the threshold, the determined value of PXLgain increases as the gray value decreases. Herein, the threshold depends on the properties (e.g., size, drive power, service life, etc.) of the display device and the purpose of use thereof. By applying the computed differential gain PXLgain to the input gray shifted to lower gray, the output gray of output data RGB' is determined.

For example, if the input gray is low, a relatively high differential gain PXLgain is applied to the input gray, and thus output gray levels significantly extended to high gray levels is determined. Thereby, the frequency of low gray values of the output image is lower compared to that of the input image, and thus overall brightness and visibility of the image are enhanced. If the input gray is high, a relatively low differential gain PXLgain is applied to the input gray, and thus output gray extended slightly to higher gray levels is determined. Thereby, variation of the frequency of high gray values of the output image is lowered compared to the case of the input image, and thus clustering of high gray values may be minimized, while maintaining presentation of high gray values.

Figure 2:
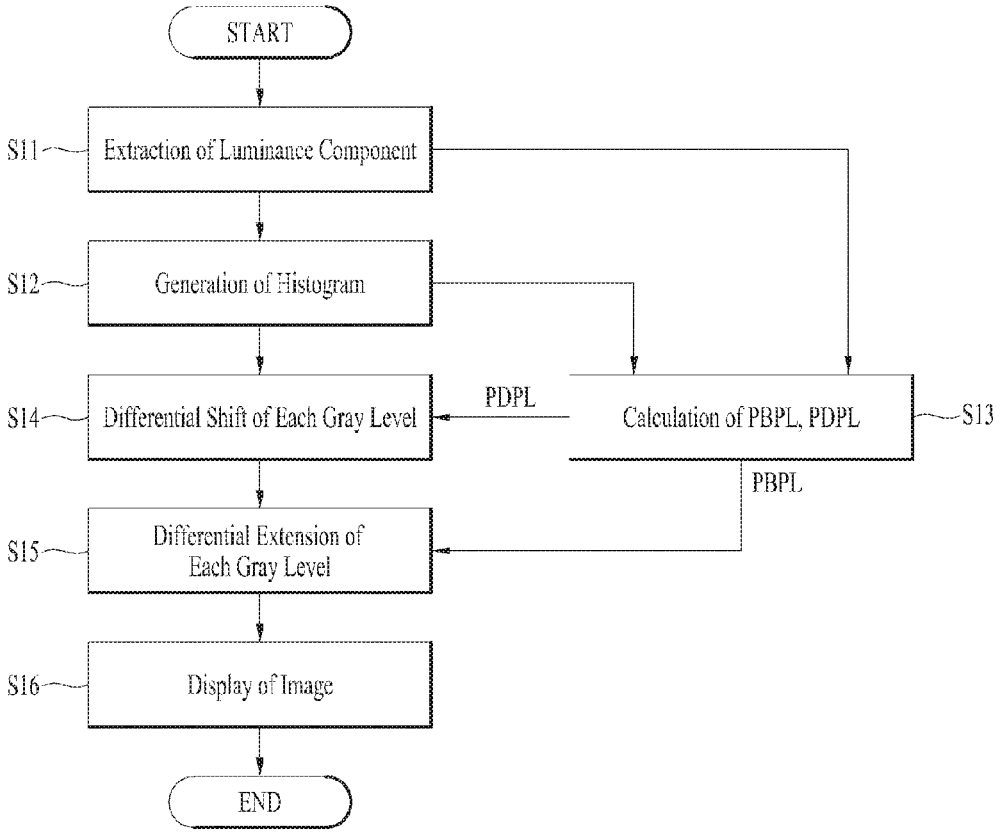
FIG. 2 is a flowchart illustrating an image processing method using the image processing circuit shown in FIG. 1.

FIG. 2 is a flowchart illustrating an image processing method according to an embodiment of the present measure. FIG. 2 will be described in connection with the image processing circuit illustrated in FIG. 1.

When image data of the current frame is input to the luminance component extractor 122 shown in FIG. 2, luminance components Y are extracted from the image data (step S11).

By analyzing the luminance components Y of each frame extracted by the luminance component extractor 122, the histogram analyzer 124 generates a histogram for each frame. The histogram analyzer calculates the maximum luminance component Ymax and minimum luminance component Ymin from the generated histogram (step S12).

Then, the PDPL is calculated using each input gray Grayij of the input image and the maximum luminance component Ymax generated by the histogram analyzer in Equation 2, and the PBPL is calculated using each input gray Grayij of the input image in Equation 3 (step S13).

Then, each input gray value $Gray_{in}$ is shifted to lower gray levels by the shift constant C(shift) calculated in Equation 4 (step S14).

Then, a differential gain for each input gray level is calculated by multiplying the PBPL, a gain for each gray level reflecting the perception properties and the gain constant in Equation 5, and then an operation is performed on the calculated differential gain values and the gray values of the input image data. Thereby, output data RGB' having a histogram extended to higher gray levels is generated using the differential gain values according to the input gray values (steps S15 and S16).

Figure 3:
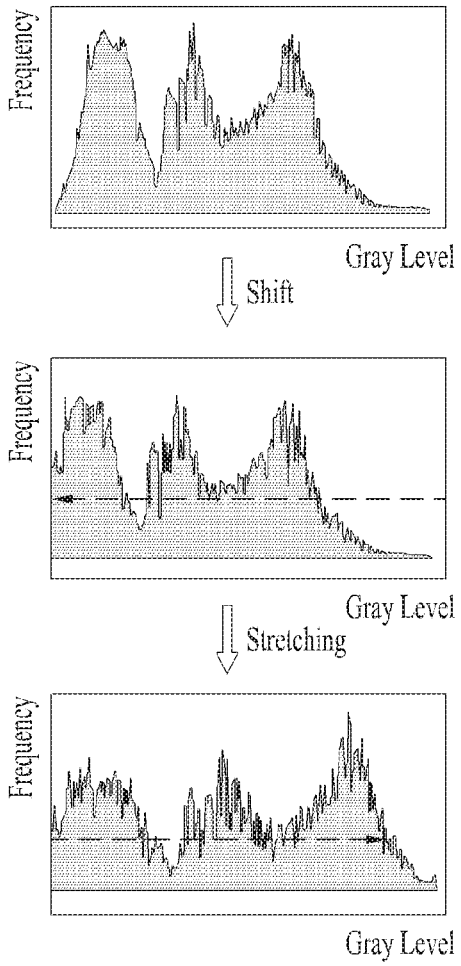
FIG. 3 illustrates histograms of input data and correction data of an input image and change of the image according to an embodiment of an image processing method of the present invention.

FIG. 3 illustrates histograms of input data and output data of an input image and change of the image according to an embodiment of an image processing method of the present disclosure.

Figure 4A:
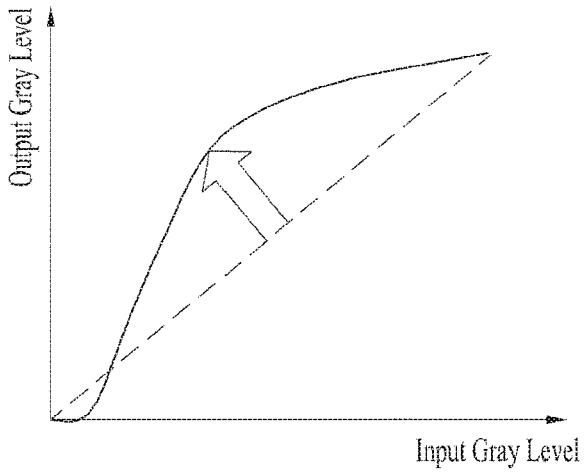
FIGS. 4A and 4B illustrate output gray levels with respect to input gray levels according to an embodiment of an image processing method of the present invention.

As shown in FIG. 3, by performing a differential shift of histogram distribution of input gray levels of an input image to lower gray levels, the image is darkened. That is, for an image having a low PDPL, a shift is performed to a small extent to lower the degree of saturation of low gray levels. For an image having a high PDPL, a shift is performed to a proper extent to maintain the distribution property of the histogram of the image. Thereby, as output gray levels are shifted to lower gray levels, a graph of the output gray levels with respect to the input gray levels is obtained as shown in FIG. 4A.

Figure 4B:
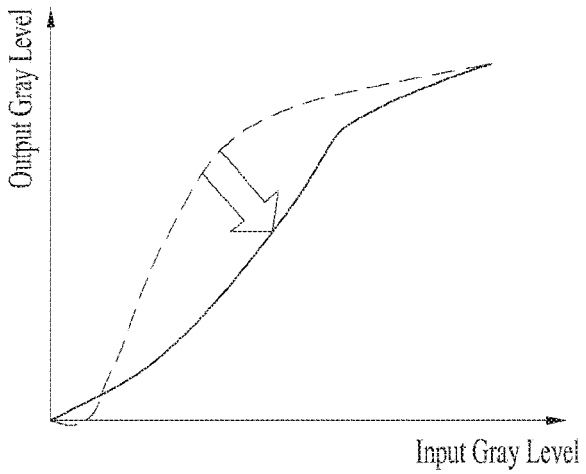

By performing a differential extension of an input image shifted to lower gray levels to higher gray levels, an overall brightness of the image is enhanced. Thereby, as the output gray levels extends to higher gray levels, a graph of the output gray levels with respect to the input gray levels is obtained shown in FIG. 4B. As each input gray level is provided with a differential gain proportional to the PBPL, and the histogram is extended to higher gray levels, overall brightness of the image may be enhanced, while gray level presentation is maintained.

In this way, a differential shift of each gray level to a lower gray level is performed based on the PDPL reflecting low gray distribution of the input image, and then differential extension of each gray level to a higher gray level is performed based on the PBPL reflecting high gray distribution of the image. As a differential shift to lower gray levels is performed, birdcaging of low gray levels may be minimized and presentation of low gray levels may be enhanced according to brightness characteristics of the image. In addition, as the histogram of high gray levels is extended, clustering of high gray levels may be minimized, and overall brightness of the image may be enhanced. Further, according to an embodiment, output data is corrected through adjustment of input data values of each input image rather through than gamma adjustment.

Figure 5A:
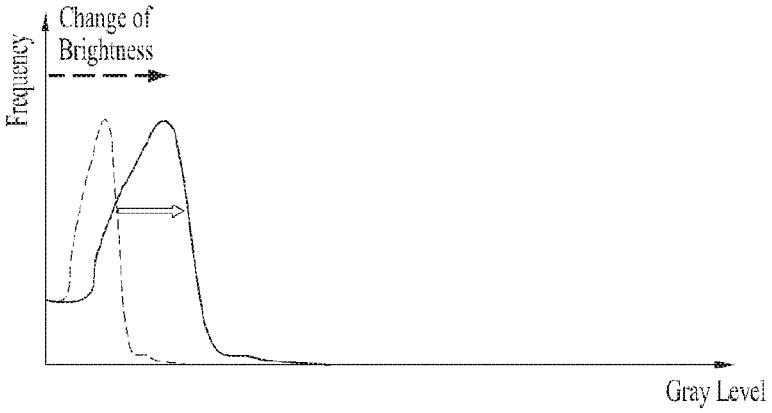
FIGS. 5A to 5C illustrate histograms and change of an input image according to distribution of gray levels of the image according to an embodiment of the present invention.
Figure 5B:
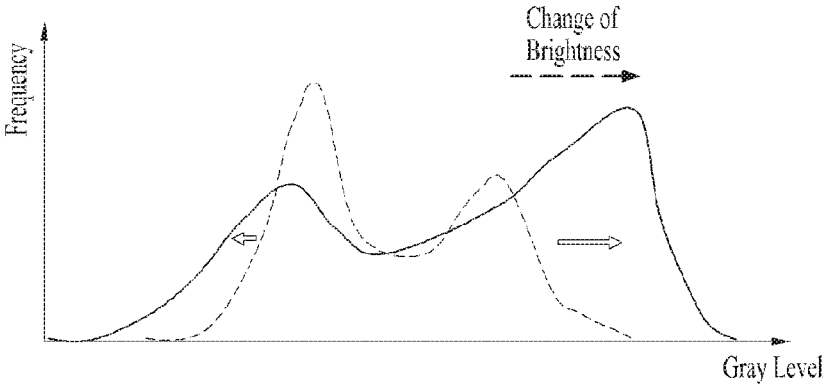
Figure 5C:
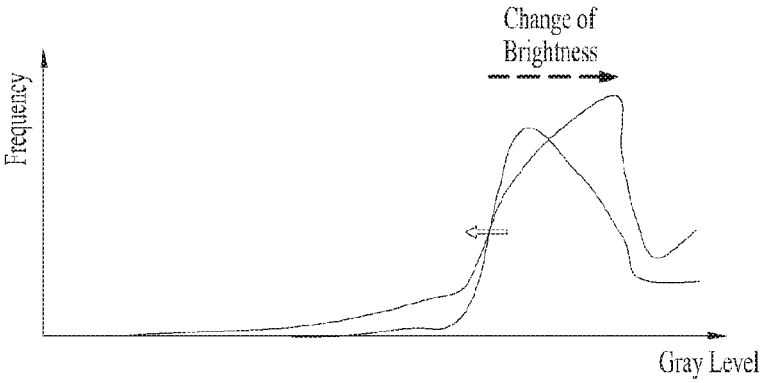

FIGS. 5A to 5C illustrate histograms and change of an input image according to distribution of gray levels of the image according to an embodiment of the present disclosure.

If low gray levels are densely distributed in an input image as shown in FIG. 5A, a differential shift is performed for each input gray level, and then differential extension is performed for the gray levels. Thereby, the corresponding output image has a wide distribution of low gray levels compared to the input image, and thus presentation of the low gray levels may be improved.

If all gray levels are uniformly distributed in an input image, as shown in FIG. 5B, a differential shift is performed for each input gray level, and then a differential extension is performed for the gray levels. Thereby, the corresponding output image has a wide distribution of low gray levels and high levels, and thus color reproduction may be enhanced.

If high gray levels are excessively distributed in an input image as shown in FIG. 5C, a differential shift is performed for each input gray level, and then a differential extension is performed for the gray levels. Thereby, an overall brightness of the output image may be improved, while presentation of high gray levels is maintained.

Figure 6:
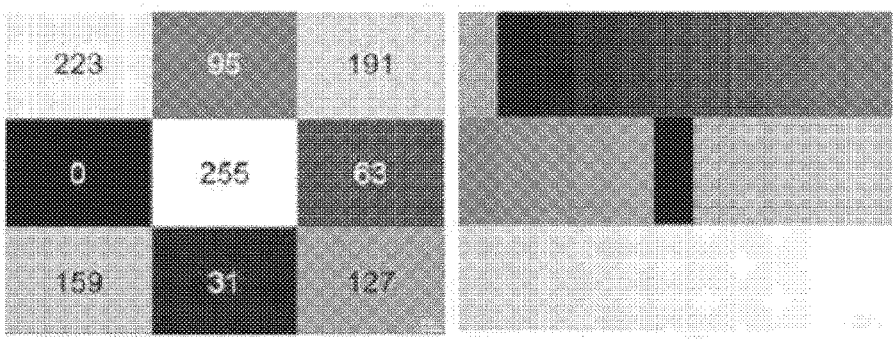
FIG. 6 illustrates a pattern for measurement of gamma characteristics of a display device to which an image processing circuit is applied according to an embodiment of the present invention.

FIG. 6 illustrates gamma characteristics of a display device using an image processing circuit according to an embodiment of the present disclosure.

When a gamma measurement is performed using a snaking constant pixel level (SCPL) pattern shown in FIG. 6, different gamma characteristics are provided according to brightness levels because images are determined based on the brightness perception properties of human beings. In particular, when the SCPL pattern shown in FIG. 6 is changed, a pattern in which the APL is changed with the PBPL and PDPL fixed or a pattern in which the APL is fixed with the PBPL and PDPL changed may be formed. According to this embodiment, in the pattern in which the APL is changed with the PBPL and PDPL fixed, the relationship between the measured input gray levels and the output gray levels remains constant. In the pattern in which the APL is fixed with the PBPL and PDPL changed, the relationship between the measured input gray levels and the output gray levels changes continuously.

Figure 7:
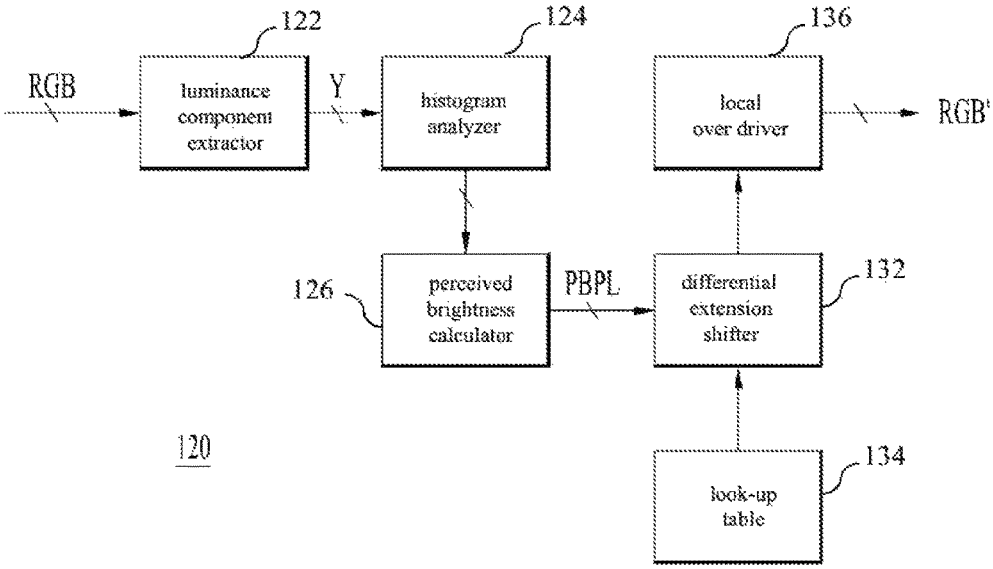
FIG. 7 is a block diagram illustrating an image processing circuit according to another embodiment of the present invention.

FIG. 7 is a block diagram illustrating an image processing circuit according to another embodiment of the present disclosure.

Referring to FIG. 7, an image processing circuit includes a luminance component extractor 122, a histogram analyzer 124, a perceived brightness calculator 126, a differential extension unit 132, a look-up table 134 and a local overdriver 136. In FIG. 7, the luminance component extractor 122, the histogram analyzer 124, the perceived brightness calculator 126, the differential extension unit 132 and the look-up table 134 corresponds to the luminance component extractor 122, the histogram analyzer 124, the perceived brightness calculator 126, the differential extension unit 132 and the look-up table 134 illustrated in FIG. 1, and thus a detailed description thereof will be omitted.

The local overdriver 136 selectively increases luminance of high gray levels higher than a threshold gray level and maintains luminance of low/mid gray levels lower than the threshold gray level in an input image of a single frame to which differential gains are applied to respective gray levels based on the PBPL, using the differential extension unit 132.

Figure 8:
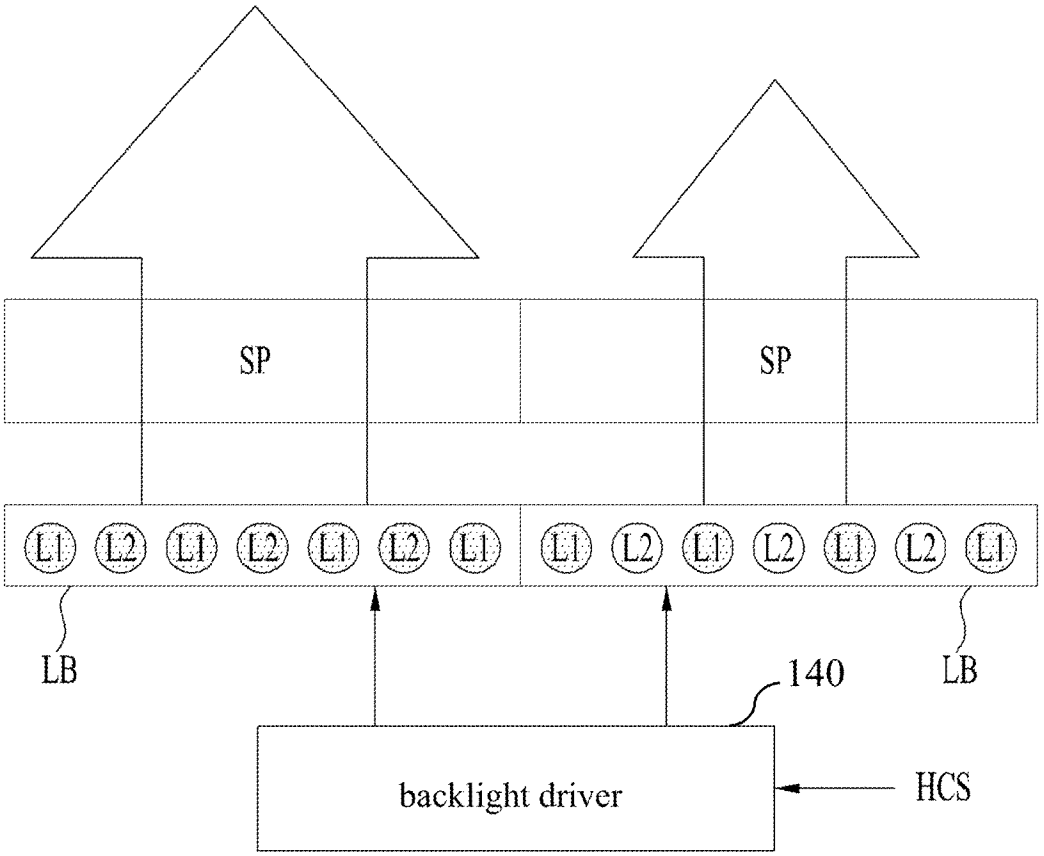
FIG. 8 is a cross-sectional view illustrating a liquid crystal display device locally overdriven through a local overdriver shown in FIG. 7.
Figure 9:
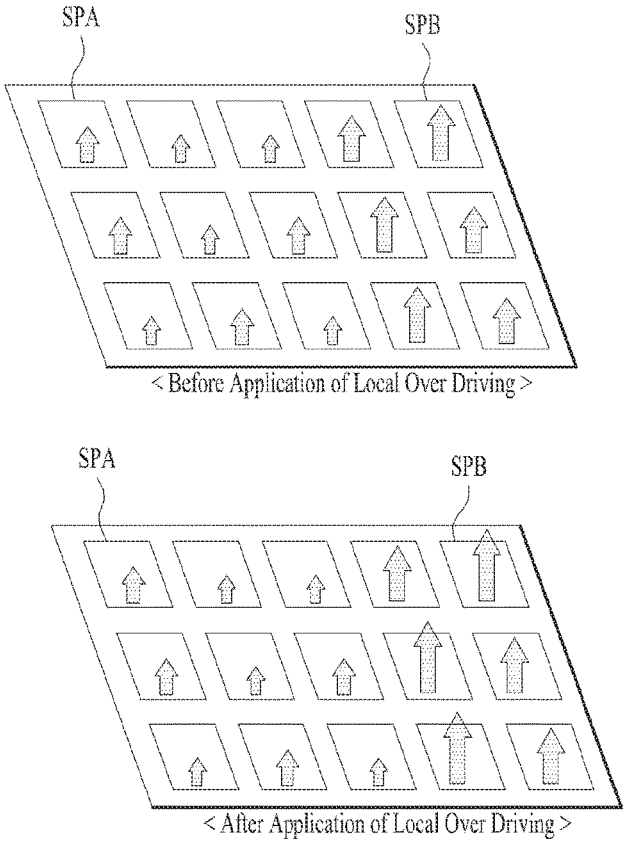
FIG. 9 is a cross-sectional view illustrating an organic light emitting display device locally overdriven through the local overdriver shown in FIG. 7.

To this end, when the local overdriver 136 is applied to a liquid crystal display device, the local overdriver 136 generates a luminance control signal HCS and supplies the same to a backlight driver 140 such that a light source block LB supplying light to subpixels for implementing high gray levels have higher luminance than a light source block LB supplying light to subpixels for implementing low/middle gray levels, as shown in FIG. 8. The backlight driver 140 drives multiple light source blocks LB in response to the luminance control signal HCS such that the number of light sources which are turned on in the region in which high gray levels are implemented is greater than the number of light sources which are turned on in the region in which low/middle gray levels are implemented. Herein, each of the multiple light source blocks LB is provided with a first light source L1 and a second light source L2. By selectively turning on the first light sources L1, first peak luminance may be implemented. By turning on all the first and second light sources L1 and L2, the liquid crystal display device may implement a second peak luminance higher than the first peak luminance Herein, the first peak luminance is a typical maximum luminance which is set in consideration of power consumption and service life of the display device, and the second peak luminance is a maximum luminance implementable by the display device.

The backlight driver 140 turns off the second light sources L2 of the light source blocks LB supplying light to subpixels SP for implementing low/middle gray levels, and selectively turns on the first light sources L1, in response to the luminance control signal HCS of the logic value "low". Using the light generated from the first light sources L1 which are turned on, the subpixels SP for implementing low/middle gray levels may implement luminance corresponding to a gray level, namely luminance lower than the first peak luminance. In addition, the backlight driver 136 turns on the first and second light sources L1 and L2 of the light source block supplying light to subpixels SP for implementing high gray levels. Using the light generated from the first and second light sources L1 and L2 which are turned on, the subpixels SP for implementing high gray levels may implement luminance within the second peak luminance higher than the first peak luminance, thereby extending distribution of high gray levels.

Additionally, when the local overdriver 136 is applied to a liquid crystal display device, the local overdriver 136 may adjust pulse width modulation (PWM) signals for the light source block LB supplying light to subpixels for implementing high gray levels and light source block LB supplying light to subpixels for implementing low/middle gray levels. That is, the local overdriver 136 generates a PWM signal corresponding to a dimming value for setting the duration for which the light source block LB supplying light to subpixels or implementing high gray levels is turned on to be longer than the duration for which the light source block LB supplying light to subpixels for implementing low/middle gray levels. Then, the local overdriver 136 supplies the PWM signal to the backlight driver 140.

The backlight driver 140 drives multiple light source blocks LB in response to local dimming values for the respective light source blocks LB such that the light sources disposed in the region in which high gray levels are implemented are turned on for a longer time than the light sources disposed in the region in which low/middle gray levels are implemented. Using the light generated from the light source block LB which is turned on for a relatively short time, the subpixels SP for implementing low/middle gray levels may implement typical luminance corresponding to the determined gray level. In addition, using the light generated from the light source block LB which is turned on for a relatively long time, the subpixels SP for implementing low/middle gray levels may implement luminance within the second peak luminance, thereby extending distribution of high gray levels.

When the local overdriver 136 is applied to an organic light emitting display device, the local overdriver 136 modulates image data of gray levels higher than or equal to a threshold gray level by selectively applying differential gains to the image data. A relative overcurrent is applied to the subpixels SPB supplied with the modulated image data, and thus the subpixels are overdriven such that any luminance within the second peak luminance is implementable. On the other hand, a reference current corresponding to the typical luminance is applied to the subpixels SPA corresponding to the low/middle gray level region such that the subpixels are driven in a typical manner.

Figure 10:
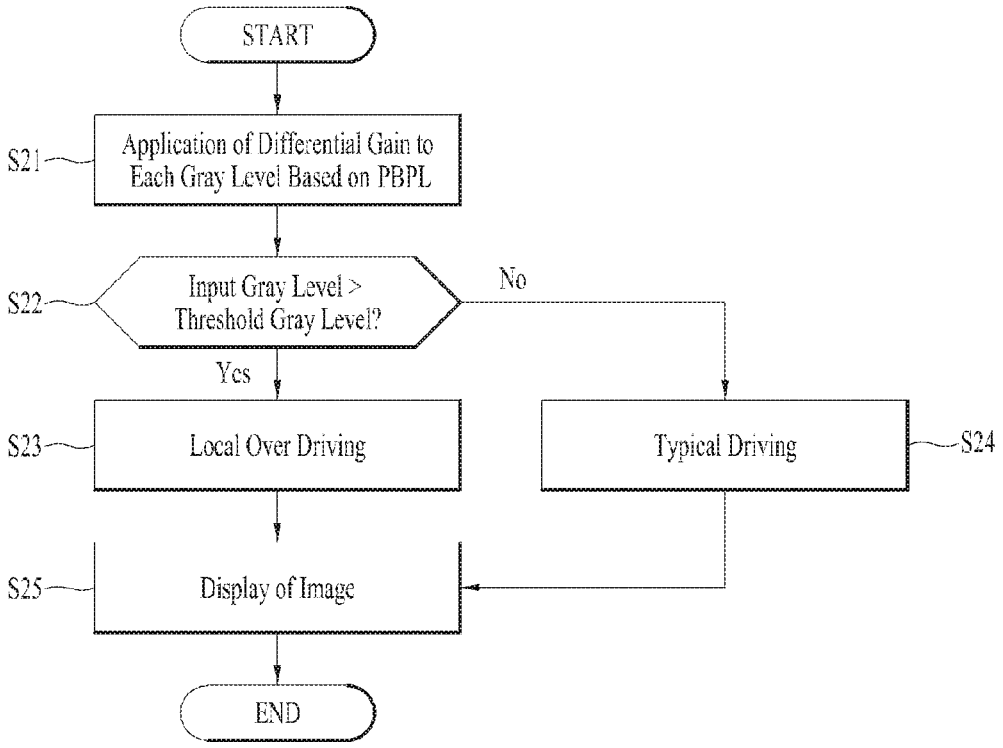
FIG. 10 is a flowchart illustrating an image processing method using the image processing circuit shown in FIG. 7.

FIG. 10 is a flowchart illustrating an image processing method according to another embodiment of the present disclosure. Hereinafter, FIG. 10 will be described in connection with the image processing circuit shown in FIG. 7.

When image data of a single frame is input to the luminance component extractor 122 illustrated in FIG. 10, luminance components Y are extracted from the image data. By analyzing the extracted luminance components Y of one frame, the histogram analyzer 124 generates a histogram of the frame. In addition, the histogram analyzer calculates the maximum luminance component Ymax and minimum luminance component Ymin from the generated histogram. Then, the histogram analyzer calculates the PBPL using each input gray Grayij of the input image in Equation 3 (step S13). Then, Then, a differential gain for each input gray level is calculated by multiplying the PBPL, a gain for each gray level reflecting the perception properties and the gain constant in Equation 5, and then an operation is performed on the calculated differential gain values and the gray values of the input image data. Thereby, image data having a histogram extended to higher gray levels is generated by applying differential gain values to the respective gray levels based on the PBPL (step S21).

If the input gray levels of the image of a single frame whose histogram has been extended to higher gray levels are higher than or equal to a threshold gray level (step S22), a drive device (e.g., liquid crystal cell or light emitting cell) or backlight unit corresponding to the input gray levels is locally overdriven (step S23). In addition, If the input gray levels of the image of a single frame whose histogram has been extended to higher gray levels are lower than the threshold gray level, the drive device (e.g., liquid crystal cell or light emitting cell) or backlight unit corresponding to the input gray levels is driven in a typical manner (step S24). Thereby, luminance corresponding to input gray levels is maintained in the low/middle gray levels according to the gamma curve of typical luminance, while the second peak luminance higher than or equal to the first peak luminance, which is the typical luminance, may be implemented in the high gray levels by overdriving the light emitting device (backlight unit of the liquid crystal display device or light emitting cell of the organic light emitting display device). Thereby, an image with enhanced presentation of high gray levels is implemented (step S25).

According to this embodiment, luminance may be linearly increased according to the gray levels only for a local bright region in the input image, and accordingly presentation of gray levels may be enhanced as distribution of gray levels in the high gray level region is extended. Further, since only the local bright region in the input image is overdriven, power consumption may be reduced and the service life may be prevented from being reduced, compared to the case where the whole region is overdriven.

Figure 11:
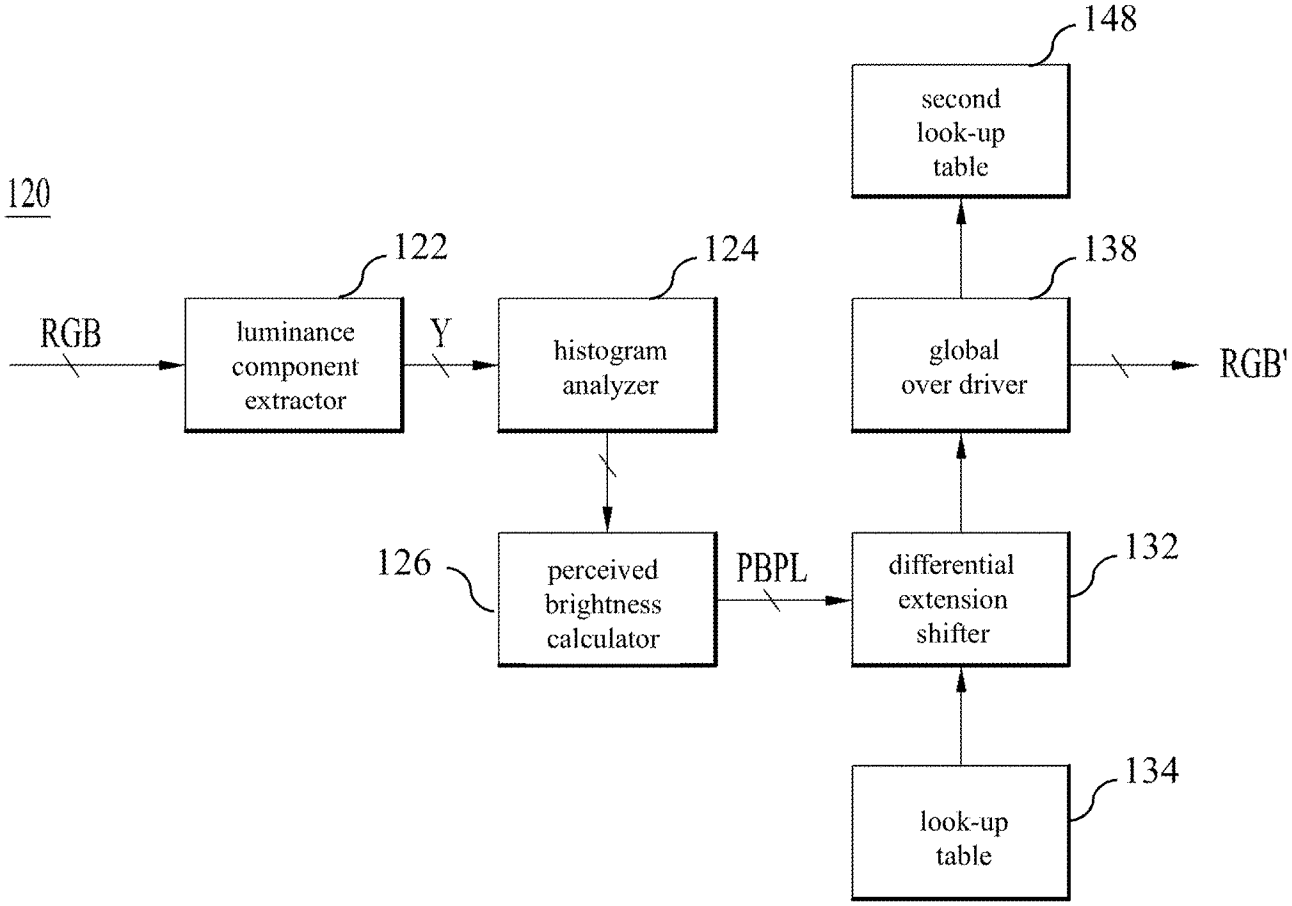
FIG. 11 is a block diagram illustrating an image processing circuit according to yet another embodiment of the present invention.

FIG. 11 is a block diagram illustrating an image processing circuit according to yet another embodiment of the present disclosure.

Referring to FIG. 11, an image processing circuit includes a luminance component extractor 122, a histogram analyzer 124, a perceived brightness calculator 126, a differential extension unit 132, a look-up table 134 and a global overdriver 138. The luminance component extractor 122, histogram analyzer 124, perceived brightness calculator 126, differential extension unit 132, and look-up table 134 shown in FIG. 11 are the same as the luminance component extractor 122, histogram analyzer 124, perceived brightness calculator 126, differential extension unit 132 and look-up table 134 shown in FIG. 1, and thus a detailed description thereof will be omitted.

The global overdriver 138 selectively increases luminance of gray levels higher than a threshold gray level in an input image of a single frame in which differential gains are applied to respective input gray levels based on the PBPL, and maintains luminance of low/middle gray levels lower than the threshold gray level, through the differential extension unit 132.

Figure 12:
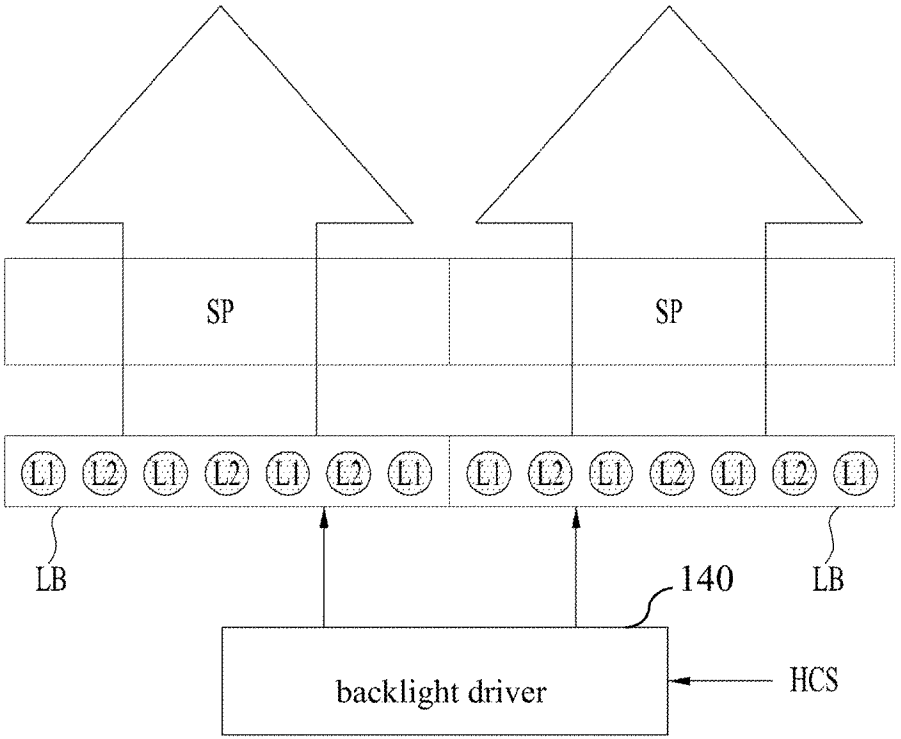
FIG. 12 is a cross-sectional view illustrating a liquid crystal device globally overdriven through the global overdriver shown in FIG. 11.

To this end, when the global overdriver 138 is applied to a liquid crystal display device, if an input image of a single frame includes a gray level higher than or equal to the threshold gray level as shown in FIG. 12, the global overdriver 138 generates a luminance control signal HCS and supplies the same to a backlight driver 140 such that luminance higher than when the input image does not contain any gray level higher than or equal to the threshold gray level is produced. The backlight driver 140 drives multiple light source blocks LB in response to the luminance control signal HCS such that more light sources are turned on for the image containing a gray level higher than or equal to the threshold gray level than when the image does not contain any gray level higher than or equal to the threshold gray level.

That is, if the input image of a single frame consists of low/mid gray levels lower than the threshold gray level, the backlight driver 140 turns off the second light sources L2 of the light source blocks LB and selectively turns on the first light sources L1, in response to the luminance control signal HCS of the logic value "low". Using light generated from the first light sources L1 which are turned on, luminance corresponding to the input image of a single frame consisting of low/middle of gray levels is implemented. In addition, if the input image of a single frame contains a gray level higher than or equal to the threshold gray level, the backlight driver 136 turns on the first and second light sources L1 and L2 of the light source block in response to a luminance control signal HCS of the logic value "high". As the light generated from the first and second light sources L1 and L2 which are turned on is used, the overall luminance of the liquid crystal display device increases by i times the luminance obtained when light generated from the first light sources L1 is used (wherein, i is a positive integer greater than 1).

Figure 13:
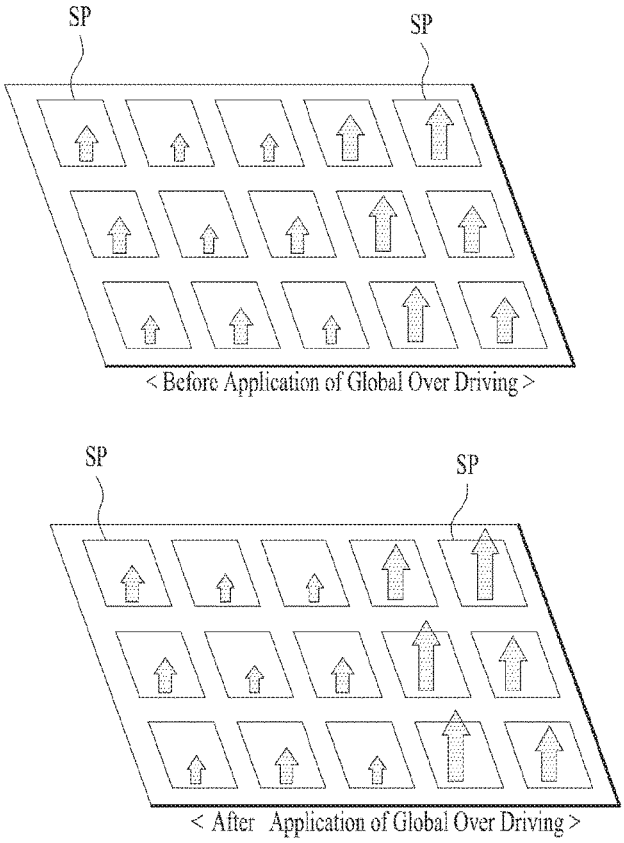
FIG. 13 is a cross-sectional view illustrating an organic light emitting display device globally overdriven through the global overdriver shown in FIG. 11.
Figure 14:
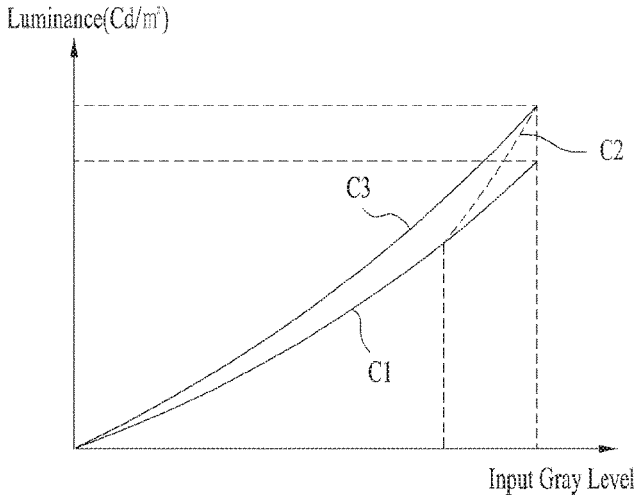
FIG. 14 illustrates a gamma curve employed in the global overdriver shown in FIG. 11.

Additionally, when the global overdriver 138 is applied to a liquid crystal display device, if an input image of a single frame includes a gray level higher than or equal to the threshold gray level, the global overdriver 138 generates a PWM signal corresponding to a dimming value for increase of the turning-on duration, and supplies the same to the backlight driver 140. If the input image of a single frame includes a gray level higher than or equal to the threshold gray level, the backlight driver 140 increases the duration for which the light sources are turned on, in response to the PWM signal. If the input image of a single frame does not include any gray level higher than or equal to the threshold gray level, the backlight driver decreases the duration for which the light sources are turned on than when the image includes a gray level higher than or equal to the threshold gray level. Thereby, when the image includes a gray level higher than or equal to the threshold gray level, the overall luminance of the liquid crystal display device increases by i times (wherein, i is a positive integer greater than 1), as shown in FIG. 13.

When the global overdriver 138 is applied to an organic light emitting display device, the global overdriver 138 modulates image data of a single frame by applying the same frame gain value to the whole image data of the single frame. A relative overcurrent is applied to all subpixels SP supplied with the modulated image data, and thus the subpixels are overdriven such that any luminance within the second peak luminance is implementable. Thereby, the overall luminance of the liquid crystal display device increases by i times (wherein, i is a positive integer greater than 1), as shown in FIG. 13.

In addition, the global overdriver 138 select a first gamma curve C1 stored in a second look-up table 148 for low/middle gray levels higher than or equal to a threshold gray level, and selects a second gamma curve C2 stored in the second look-up table 148 for high gray levels higher than or equal to a threshold gray level. Herein, the first gamma curve C1, which is curved up more slowly than a third gamma curve C3 representing overdriving, is a typical gamma curve capable of implementing luminance within first peak luminance P1. The second gamma curve C2 is a curve increasing linearly from the luminance of a threshold gray level Gc to second peak luminance P2, which is peak luminance for overdriving. If the global overdriver 138 selects the third gamma curve C3 for overdriving for high gray levels higher than or equal to the threshold gray level, the difference in luminance between the first gamma curve C1 and the third gamma curve C3 is large and thus may be noticed by the user.

The global overdriver 138 corrects and outputs image data based on the first and second gamma curves C1 and C2 as selected. Thereby, in this embodiment, the first gamma curve C1 which is the typical gamma curve is applied to low/middle gray levels lower than the threshold gray level to maintain the typical luminance for the low/middle gray levels, and the second gamma curve C2 which increases linearly is applied to the high gray levels higher than or equal to the threshold gray level to implement luminance within the second peak luminance for the high gray levels.

Figure 15:
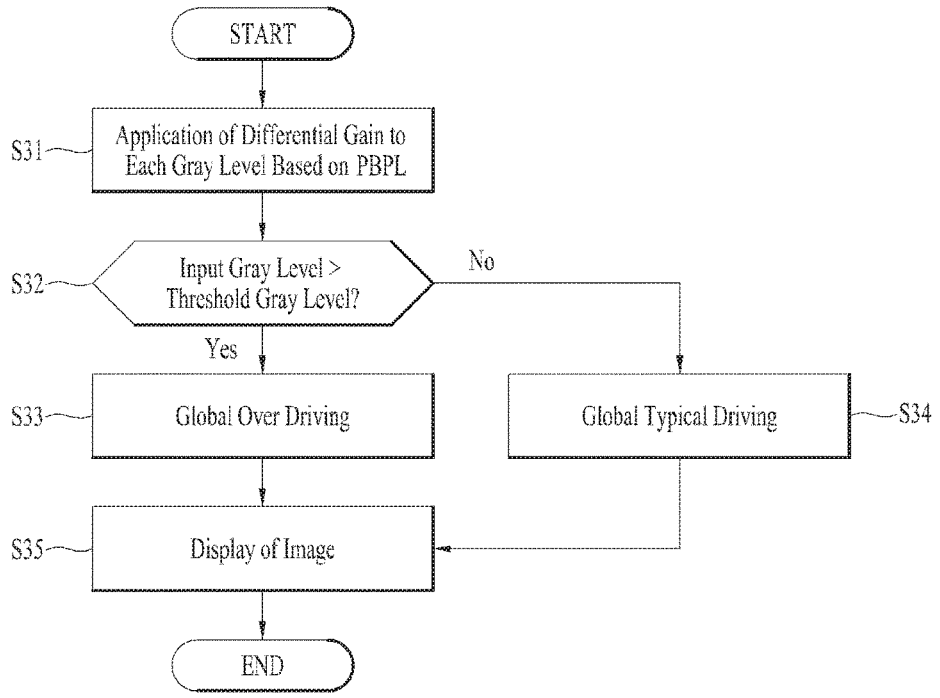
FIG. 15 is a flowchart illustrating an image processing method using the image processing circuit shown in FIG. 11.

FIG. 15 is a flowchart illustrating an image processing method according to yet another embodiment of the present disclosure. Hereinafter, FIG. 15 will be described in connection with the image processing circuit shown in FIG. 11. Step 31 illustrated in FIG. 15 is identical to step 21 illustrated in FIG. 10, and thus a detailed description thereof will be omitted.

Referring to FIG. 15, if the input gray levels of an image of a single frame having a histogram extended to higher gray levels are higher than or equal to a threshold gray level (step S32), a drive device (e.g., liquid crystal cell or light emitting cell) or backlight unit corresponding to the input gray levels is globally overdriven (step S33). That is, for the high gray levels higher than or equal to the threshold gray level, overall luminance of the backlight unit of the liquid crystal display device or the light emitting cell of the organic light emitting display device is increased, and then the image data is modulated using the second gamma curve which may implement luminance within the second peak luminance higher than the first peak luminance which is the typical luminance.

If the input gray levels of an image of a single frame having a histogram extended to higher gray levels are lower than the threshold gray level, a drive device (e.g., liquid crystal cell or light emitting cell) or backlight unit corresponding to the input gray levels is globally driven (step S34). That is, for the low/middle gray levels lower than the threshold gray level, overall luminance of the backlight unit of the liquid crystal display device or the light emitting cell of the organic light emitting display device is increased, and then luminance corresponding to the input gray levels is maintained along the first gamma curve which is capable of implementing typical luminance for the low/middle gray levels. As luminance corresponding to the input gray levels is maintained along the gamma curve of typical luminance for the low/middle gray levels, and luminance up to the second peak luminance is implementable along the second gamma curve for the high gray levels, an image with enhanced presentation of high gray levels is implemented (step S35).

Figure 16:
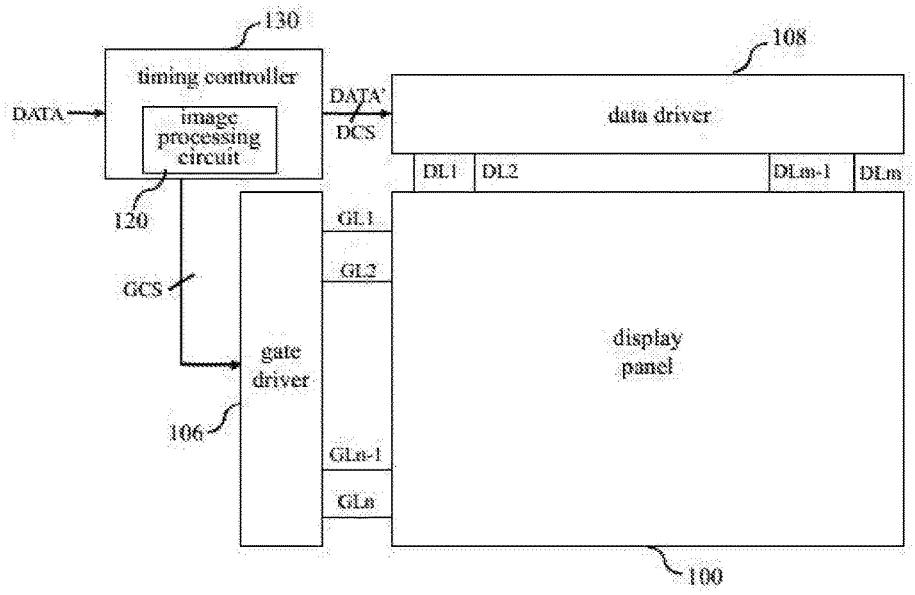
FIG. 16 is a block diagram illustrating a display device to which an image processing circuit according to an embodiment of the present disclosure is applied.

FIG. 16 is a block diagram illustrating a display device to which an image processing circuit according to an embodiment of the present disclosure is applied.

Referring to FIG. 16, a display device according to an embodiment includes a display panel 100, a panel drive unit for driving the display panel 100, the panel drive unit including a data driver 108 and a gate driver 106, and a timing controller 130 for controlling the panel drive unit.

The display panel 100 includes a pixel array of multiple pixels. The pixel array includes data lines DL supplied with a data voltage, gate lines (scan lines) GL intersecting the data lines DL and supplied with a gate pulse (or scan pulse), and pixels disposed in the form of a matrix defined by intersection between the data lines DL and the gate lines GL. Each of the pixels may include one or more TFTs and capacitors. A liquid crystal display panel or organic electroluminescence light emitting display panel may be employed as the display panel 100.

The data driver 108 converts overdriving data from the timing controller 130 into an element data voltage in response to a data control signal from the timing controller 130 and supplies the same to the data lines DL every time each gate line GL is driven.

In response to a gate control signal from the timing controller 130, the gate driver 106 sequentially drives the gate lines GL of the display panel 100. The gate driver 106 supplies a scan pulse of a gate-on voltage during a scan period corresponding to each gate line GL, and supplies a gate-off voltage during the other periods of driving of the other gate lines GL.

The timing controller 130 generates multiple synchronization signals input from a host computer 50, namely a vertical synchronization signal Vsync, a horizontal synchronization signal Hsync, a data enable signal, a data control signal DCS for controlling driving timing of the data driver 108 using a dot clock, and a gate control signal GCS for controlling driving timing of the gate driver 106. The timing controller 130 outputs the data control signal DCS and the gate control signal GCS to the data driver 108 and the gate driver 106, respectively. The data control signal DCS includes a source start pulse and source sampling clock for controlling latch of a data signal, a polarity control signal for controlling polarity of the data signal and a source output enable signal for controlling the output period of the data signal. The gate control signal GCS includes a gate start pulse and gate shift clock for controlling scanning of a gate signal and a gate output enable signal for controlling the output period of the gate signal.

The timing controller 130 performs a signal processing of image data input from a host system and supplies the processed image data to the data driver 108. That is, the image processing circuit 120 installed in the timing controller 130 according to a embodiment performs differential shift of the respective gray levels of an input image to lower gray levels based on the PDPL reflecting distribution of low gray levels of the input image, and then performs differential extension of the respective gray levels to higher gray levels based on the PBPL reflecting distribution of high gray levels of the input image. Thereby, presentation of low gray levels may be improved, and improvement of brightness of the image may be maximized.

Additionally, according to another embodiments, the image processing circuit 120 applies a differential gain to respective input gray levels of an input image based on the PBPL reflecting distribution of high gray levels of the input image, and then overdrives a light emitting device corresponding to a region for implementation of high gray levels higher than or equal to a threshold gray level. Thereby, presentation of high gray levels may be enhanced. While the image processing circuit 120 is illustrated as being installed in the timing controller 130, the image processing circuit 120 may also be positioned between the timing controller 130 and the data driver 108, or positioned at an input terminal of the timing controller 130.

According to embodiments of the present invention, since a differential shift to lower gray level is performed, birdcaging of low gray levels may be minimized or reduced and presentation of low gray level may be enhanced according to brightness characteristics of images. In addition, as a histogram of high gray levels is extended, clustering of a high gray level may be minimized or reduced and an overall brightness of an image may be enhanced. In particular, as a result of an experiment of brightness for each frame for a standard moving image introduced in the standard IEC 62087, brightness is enhanced by 31% on average and up to 67%.

In addition, according to embodiments of the present invention, since images are processed based on the perceived darkness picture level (PDPL) and perceived brightness picture level (PBPL) rather than on the APL, artifacts which may occur due to the APL may be minimized.

Moreover, according to embodiments of the present invention, a gray level-specific differential gain is applied to the low/middle gray level regions of an input image, light emitting devices are overdriven for the local high-gray level region present in the image. Thereby, presentation of high gray level may be enhanced, and thus a high dynamic range (HDR) may be obtained.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An image processing circuit comprising:

a perceived brightness calculator that calculates a perceived darkness picture level and a perceived brightness picture level indicating a level of brightness of an input image;

a differential shifter that shifts gray levels of the input image to lower gray levels based on the perceived darkness picture level;

a luminance component extractor that extracts luminance components from the input image;

a histogram generator that generates a histogram through analysis of the luminance components and extracting a maximum luminance component and a minimum luminance component from the generated histogram; and a differential extension unit that extends the gray levels of the input image shifted to the lower gray levels to higher gray levels by applying a differential gain to each gray level of the input image based on the perceived brightness picture level and outputs a modified input image having the histogram extended to the higher gray levels to display an image, wherein the perceived brightness calculator calculates the perceived darkness picture level based on an input gray level and the maximum luminance component, and calculates the perceived brightness picture level based on the input gray level, wherein, when the input gray level is greater than a level of the minimum luminance component and less than a level of the maximum luminance component, the differential shifter differentially shifts the input gray level to a lower gray level by subtracting a shift constant having a different value for the input gray level from the input gray level, wherein the shift constant has a maximum value when the input gray level is less than the level of the minimum luminance component, wherein, when the input gray level is greater than the level of the maximum luminance component, the shift constant is 0, and wherein the shift constant is proportional to the perceived darkness picture level.

2. The image processing circuit according to claim 1, wherein the perceived darkness picture level is lowered as a proportion of low gray levels of the input image increases, and is raised as the proportion of the low gray levels of the input image decreases, and wherein the perceived brightness picture level is raised as a proportion of high gray levels of the input image increases, and is lowered as the proportion of the high gray levels of the input image decreases.

3. The image processing circuit according to claim 1, wherein the differential extension unit extends the gray levels of the input image shifted to the lower gray levels to the higher gray levels based on the differential gain, the differential gain being proportional to multiplication of an input gain having a different value according to the input gray level and the perceived brightness picture level, and wherein the differential gain is set to decrease as the input gray level is shifted to a higher gray level when the calculated perceived brightness picture level is higher than a threshold level, and is set to increase as the input gray level is shifted to a lower gray level when the calculated perceived brightness picture level is lower than the threshold level.

4. A display device comprising:

a display panel for displaying an image; and an image processing circuit according to claim 1 for processing image data to be displayed on the display panel.

5. An image processing method comprising:

calculating a perceived darkness picture level and a perceived brightness picture level indicating a level of brightness of an input image;

shifting gray levels of the input image to lower gray levels based on the perceived darkness picture level;

extracting luminance components from the input image;

generating a histogram through analysis of the luminance components and extracting a maximum luminance component and a minimum luminance component from the generated histogram; and extending the gray levels of the input image shifted to the lower gray levels to higher gray levels based on the perceived brightness picture level by applying a differential gain to each gray level of the input image and outputting a modified input image having the histogram extended to the higher gray levels to display an image, wherein the perceived darkness picture level is regulated based on an input gray level and the maximum luminance component, and the perceived brightness picture level is calculated based on the input gray level, wherein the shifting gray levels of the input image comprises:

performing differential shift of the input gray level to a lower gray level by subtracting a shift constant having a different value for the input gray level from the input gray level when the input gray level is greater than a level of the minimum luminance component and less than a level of the maximum luminance component;

wherein the shift constant has a maximum value when the input gray level is less than the level of the minimum luminance component, wherein, when the input gray level is greater than the level of the maximum luminance component, the shift constant is 0, and wherein the shift constant is proportional to the perceived darkness picture level.

6. The image processing method according to claim 5, wherein the extending of the gray levels of the input image comprises:

extending the gray levels of the input image shifted to the lower gray levels to the higher gray levels based on the differential gain, the differential gain being proportional to multiplication of an input gain having a different value according to the input gray level and the perceived brightness picture level, and wherein the differential gain is set to decrease as the input gray level is shifted to a higher gray level when the calculated perceived brightness picture level is higher than a threshold level, and is set to increase as the input gray level is shifted to a lower gray level when the calculated perceived brightness picture level is lower than the threshold level.

7. A display device comprising:

a display panel for displaying an image using a light generated from a light emitting device; and an image processing circuit that processes image data to be displayed the display panel, wherein the image processing circuit comprises:

a perceived brightness calculator that calculates a perceived brightness picture level indicating a level of perceived brightness of an input image of a single frame;

a differential extension unit that extends gray levels of the input image to higher gray levels by applying a differential gain to each gray level of the input image based on the perceived brightness picture level and outputs a modified image data having a histogram extended to the higher gray levels to display an image; and an overdriver that overdrives the light emitting device disposed in a region for implementation of high gray levels higher than or equal to a threshold gray level in the gray levels of the input image extended to the higher gray levels, wherein the light emitting device comprises a plurality of light sources contained in a plurality of light source blocks disposed on a rear surface of a liquid display panel employed as the display panel, wherein, when the input image of the single frame contains image data of the high gray levels higher than or equal to the threshold gray level, the overdriver generates a control signal to turn on a larger number of light sources or turn on the light sources for a longer duration than inverse case, and wherein the overdriver applies a typical gamma curve for implementation of first peak luminance to low/middle gray levels higher than or equal to a threshold gray level in the image extended to the higher gray levels, and applies a gamma curve increasing linearly from luminance of the threshold gray level to second peak luminance higher than the first peak luminance to the high gray levels to modulate data.

8. The display device according to claim 7, wherein the differential gain is set to decrease as the input gray level is shifted to a higher gray level when the calculated perceived brightness picture level is higher than a threshold level, and is set to increase as the input gray level is shifted to a lower gray level when the calculated perceived brightness picture level is lower than the threshold level.

9. A display device comprising:

a display panel for displaying an image using a light generated from a light emitting device; and an image processing circuit that processes image data to be displayed the display panel, wherein the image processing circuit comprises:

a perceived brightness calculator that calculates a perceived brightness picture level indicating a level of perceived brightness of an input image of a single frame;

a differential extension unit that extends gray levels of the input image to higher gray levels by applying a differential gain to each gray level of the input image based on the perceived brightness picture level and outputs a modified image data having a histogram extended to the higher gray levels to display an image; and an overdriver that overdrives the light emitting device disposed in a region for implementation of high gray levels higher than or equal to a threshold gray level in the gray levels of the input image extended to the higher gray levels wherein the light emitting device is a light emitting cell of an organic light emitting display panel employed as the display panel, wherein the overdrive applies an overcurrent to the light emitting cells disposed in the region for implementation of the high gray levels higher than or equal to the threshold gray level, and wherein the overdriver applies a typical gamma curve for implementation of first peak luminance to low/middle gray levels higher than or equal to a threshold gray level in the image extended to the higher gray levels, and applies a gamma curve increasing linearly from luminance of the threshold gray level to second peak luminance higher than the first peak luminance to the high gray levels to modulate data.

10. The display device according to claim 9, wherein the differential gain is set to decrease as the input gray level is shifted to a higher gray level when the calculated perceived brightness picture level is higher than a threshold level, and is set to increase as the input gray level is shifted to a lower gray level when the calculated perceived brightness picture level is lower than the threshold level.

* * * * *